US008223106B2

(12) United States Patent
Shin

(10) Patent No.: US 8,223,106 B2
(45) Date of Patent: Jul. 17, 2012

(54) DISPLAY DEVICE AND DRIVING METHOD THEREOF

(75) Inventor: Jung-Wook Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 870 days.

(21) Appl. No.: 11/404,854

(22) Filed: Apr. 17, 2006

(65) Prior Publication Data

US 2007/0159426 A1 Jul. 12, 2007

(30) Foreign Application Priority Data

Dec. 28, 2005 (KR) ..... 10-2005-0131723
Mar. 14, 2006 (KR) ..... 10-2006-0023413

(51) Int. Cl.
*G09G 3/36* (2006.01)

(52) U.S. Cl. ..... 345/99; 345/87; 345/94; 345/98; 345/100; 713/400; 713/500; 713/501

(58) Field of Classification Search ..... 345/698, 345/699, 87–100; 349/36; 713/400–503
See application file for complete search history.

(56) References Cited

U.S. PATENT DOCUMENTS 6,078,317 A * 6/2000 Sawada ..... 345/204
6,813,721 B1 * 11/2004 Tetreault et al. ..... 713/400
2003/0156107 A1 * 8/2003 Sakashita ..... 345/213

FOREIGN PATENT DOCUMENTS

JP 10-126719 A 5/1998

OTHER PUBLICATIONS

Office Action, along with its English-language translation, issued Aug. 17, 2009 in corresponding Japanese Application No. 2006-165737.

* cited by examiner

*Primary Examiner* — Nitin Patel
*Assistant Examiner* — Saifeldin Elnafia
(74) *Attorney, Agent, or Firm* — Morgan, Lewis & Bockius LLP

(57) ABSTRACT

A driving circuit for a display device includes an input signal generator generating an input signal having one of a plurality of input frequencies corresponding to a respective one of a plurality of operating modes of the display device; a main operating clock generator responsive to the one of the plurality of frequencies to generating a main operating clock, a main frequency of the main operating clock varying in accordance with the one of the plurality of frequencies; and a control signal generator generating a control signal using the main operating clock, wherein the control signal changes in accordance with the main frequency.

7 Claims, 4 Drawing Sheets

DISPLAY DEVICE AND DRIVING METHOD THEREOF

The present invention claims the benefit of Korean Patent Application Nos. 2005-0131723 and 2006-0023413, filed in Korea on Dec. 28, 2005 and Mar. 14, 2006, respectively, which is hereby incorporated by reference in its entirety.

BACKGROUND OF THE INVENTION

1. Field of the Invention

The present application relates to a display device and, more particularly, to a display device and a driving method thereof.

2. Discussion of the Related Art

Display devices have typically used cathode-ray tubes (CRT). Presently, much effort has been made to study and develop various types of flat panel displays, such as liquid crystal display (LCD) devices, plasma display panels (PDP), field emission displays, and electro-luminescence displays (ELD), as alternatives to CRT. In particular, the LCD devices have been widely used. The LCD devices provide several advantages, such as high resolution, light weight, thin profile, compact size, and low power supply requirements.

In general, an LCD device includes two substrates that are spaced apart and face each other with a liquid crystal material interposed between the two substrates. The two substrates include electrodes that face each other such that a voltage applied between the electrodes induces an electric field across the liquid crystal material. The light transmissivity of the LCD device can be changed by adjusting the intensity of the induced electric field to change an alignment of the liquid crystal molecules in the liquid crystal material. Thus, the LCD device displays images by varying the intensity of the induced electric field.

The LCD device is supplied with data signals and control signals from an external system. The LCD device may be categorized into a digital type and an analog type whether the externally provided data signals are in a digital or analog form.

FIG. 1 is a block diagram of an analog type LCD device of the related art, FIG. 2 is a schematic view of a liquid crystal panel shown in FIG. 1, and FIG. 3 is a block diagram of the related art main operating clock generating portion interfacing the timing controller circuit shown in FIG. 1. Referring to FIGS. 1 to 3, the related art LCD device 1 includes a liquid crystal panel 2 and a driving circuit portion 26. The driving circuit portion 26 includes a printed circuit board (PCB) (not shown).

An decoder 16 is supplied with data signals of analog form including red (R), green (G) and blue (B) data signals, and a synchronization signal Csync, from an external system, such as a personal computer. The data signals are synchronized by the reference synchronization signal (Csync) and inputted to the decoder 16. The decoder 16 decodes and transfers the data signals according to the control signals supplied thereto.

The liquid crystal panel 2 includes a plurality of gate lines GL1 to GLn and a plurality of data lines DL1 to DLm. The gate lines GL1 to GLn and the data lines DL1 to DLm cross each other to define a plurality of pixel regions. A thin film transistor TFT and a liquid crystal capacitor $C_{LC}$ are formed in each pixel region. The liquid crystal capacitor $C_{LC}$ includes a pixel electrode (not shown), a common electrode (not shown), and a liquid crystal layer (not shown) between the pixel and common electrodes.

The timing controller 12 supplies control signals to the decoder 16 and data and gate drivers 18 and 20 to operate the decoder 16 and the gate and data drivers 18 and 20.

The data driver 18 transfers the data signals the data lines DL1 to DLm according to the control signals supplied thereto.

The gate driver 20 sequentially outputs gate voltages to the gate lines GL1 to GLn to enable the gate lines GL1 to GLn sequentially. Each of the gate lines GL1 to GLn is enabled during one horizontal period. The thin film transistor TFT is turned on and off according to on and off states of the gate voltage. While the thin film transistor TFT is turned on, the data voltage is supplied to the liquid crystal capacitor $C_{LC}$.

A power generator 14 supplies power required for the components of the driving circuit portion 26 and supplies a common voltage for the common electrode.

The driving circuit portion 26 further includes a main operating clock generating portion 13. The timing controller 12 generates the control signals using a main operating clock (Mclk).

The main operating clock generating portion 13 generates the main operating clock Mclk having a fixed frequency. Accordingly, the related art LCD device can only driven in a specific operating mode corresponding to the fixed frequency of the main operating clock Mclk. In other words, the related art LCD device is not compatible with other operating modes requiring different frequencies of the main operating clock Mclk. For example, a change of a display resolution or a change between from a full screen mode to a zoom-in mode cannot be achieved in the related art LCD device.

SUMMARY OF THE INVENTION

Accordingly, the present invention is directed to a display device and a driving method thereof, which substantially obviate one or more problems due to limitations and disadvantages of the related art.

An object of the present invention is to provide a display device, and a driving method thereof, that is compatible with various operating modes at different frequencies.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes an input signal generator generating an input signal having one of a plurality of input frequencies corresponding to a respective one of a plurality of operating modes of the display device; a main operating clock generator generating a main operating clock using the input signal and a reference signal, wherein a main frequency of the main operating clock varies in accordance with the input frequency, and a reference frequency of the reference signal is constant irrespective of the operating modes; and a control signal generator generating a control signal using the main operating clock, wherein the control signal changes in accordance with the main frequency.

In another aspect, a method of driving a display device includes generating an input signal having one of a plurality of input frequencies corresponding to a respective one of a plurality of operating modes of a display device; generating a main operating clock using the input signal and a reference signal, including varying a main frequency of the main operating clock in accordance with the input frequency while keeping constant a reference frequency of the reference signal irrespective of the operating modes; and generating a control signal using the main operating clock, including changing the control signal in accordance with the main frequency.

In another aspect, a display device includes an input signal generator generating an input signal having one of a plurality of input frequencies corresponding to a respective one of a plurality of operating modes of the display device; a main operating clock generator generating a main operating clock using the input signal and a reference signal, wherein an input-to-output conversion attribute of the main operating clock generator is constant regardless of the operating modes; and a control signal generator generating a control signal using the main operating clock, wherein the control signal changes in accordance with the main frequency.

In another aspect, a driving circuit for a display device includes an input signal generator generating an input signal having one of a plurality of input frequencies corresponding to a respective one of a plurality of operating modes of the display device; a main operating clock generator responsive to the one of the plurality of input frequencies to generating a main operating clock, a main frequency of the main operating clock varying in accordance with the one of the plurality of frequencies; and a control signal generator generating a control signal using the main operating clock, wherein the control signal changes in accordance with the main frequency.

It is to be understood that both the foregoing general description and the following detailed description of the present invention are exemplary and explanatory and are intended to provide further explanation of the invention as claimed.

DETAILED DESCRIPTION OF EXEMPLARY EMBODIMENTS

Figure 1:
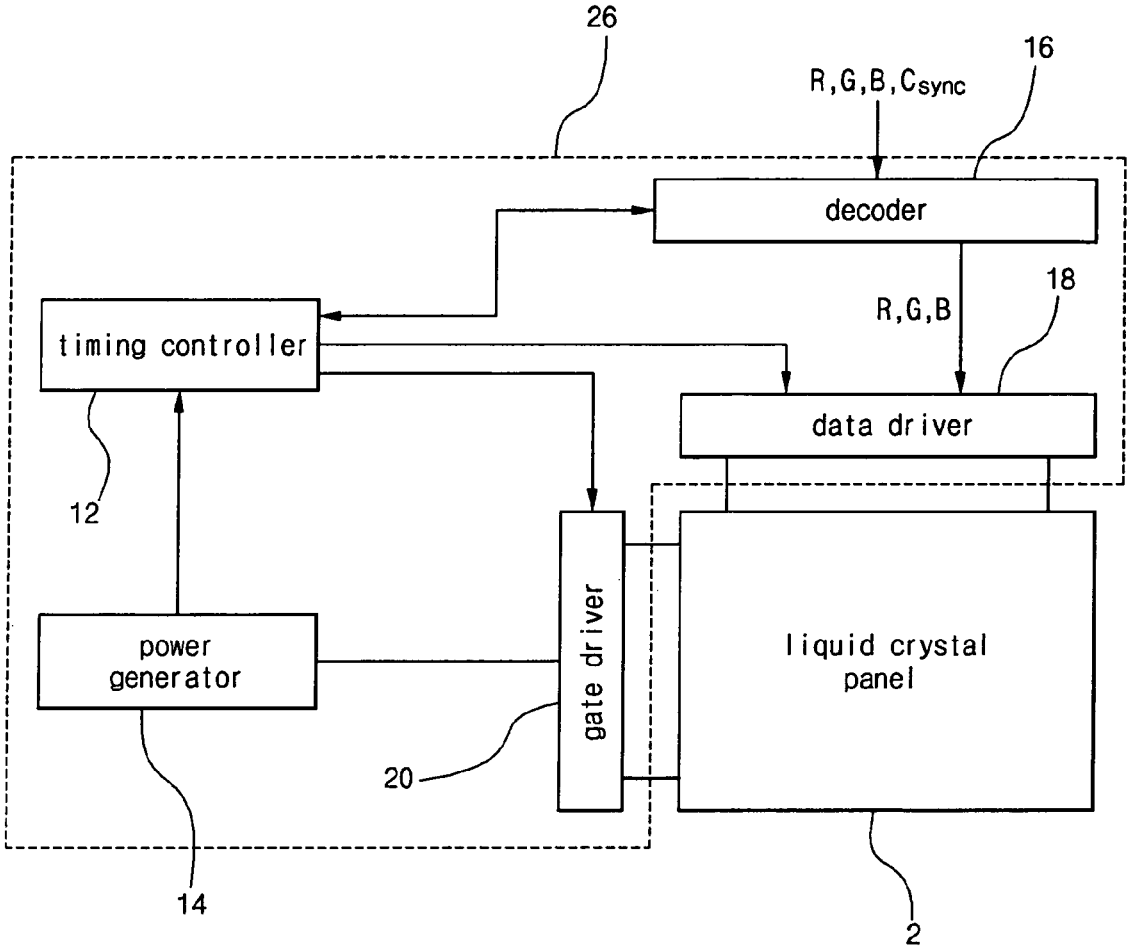
FIG. 1 RELATED ART
FIG. 1 is a block diagram of an analog type LCD device of the related art.
Figure 2:
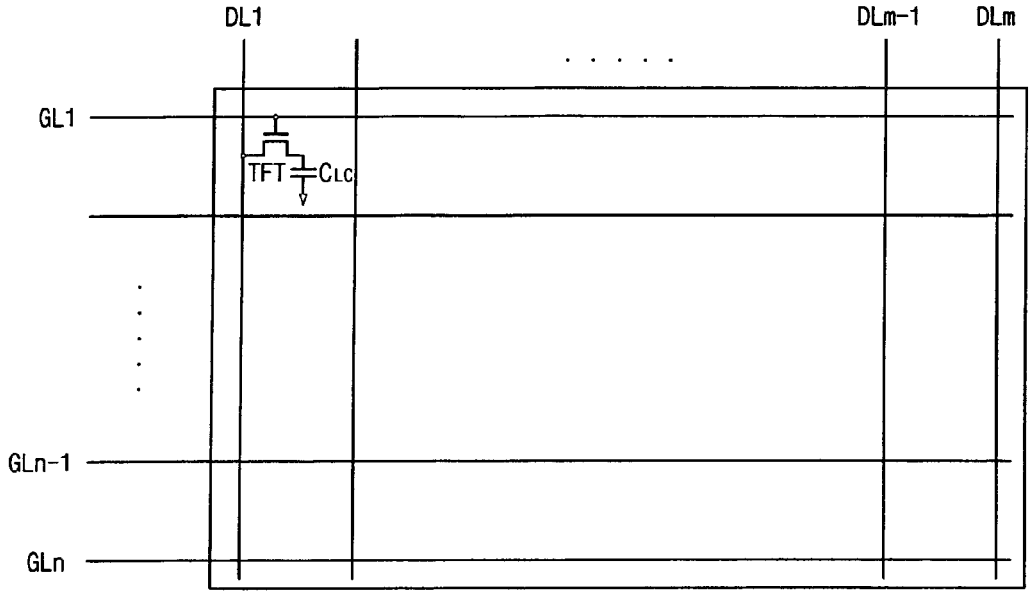
FIG. 2 RELATED ART
FIG. 2 is a schematic view of a liquid crystal panel shown in FIG. 1.
Figure 3:
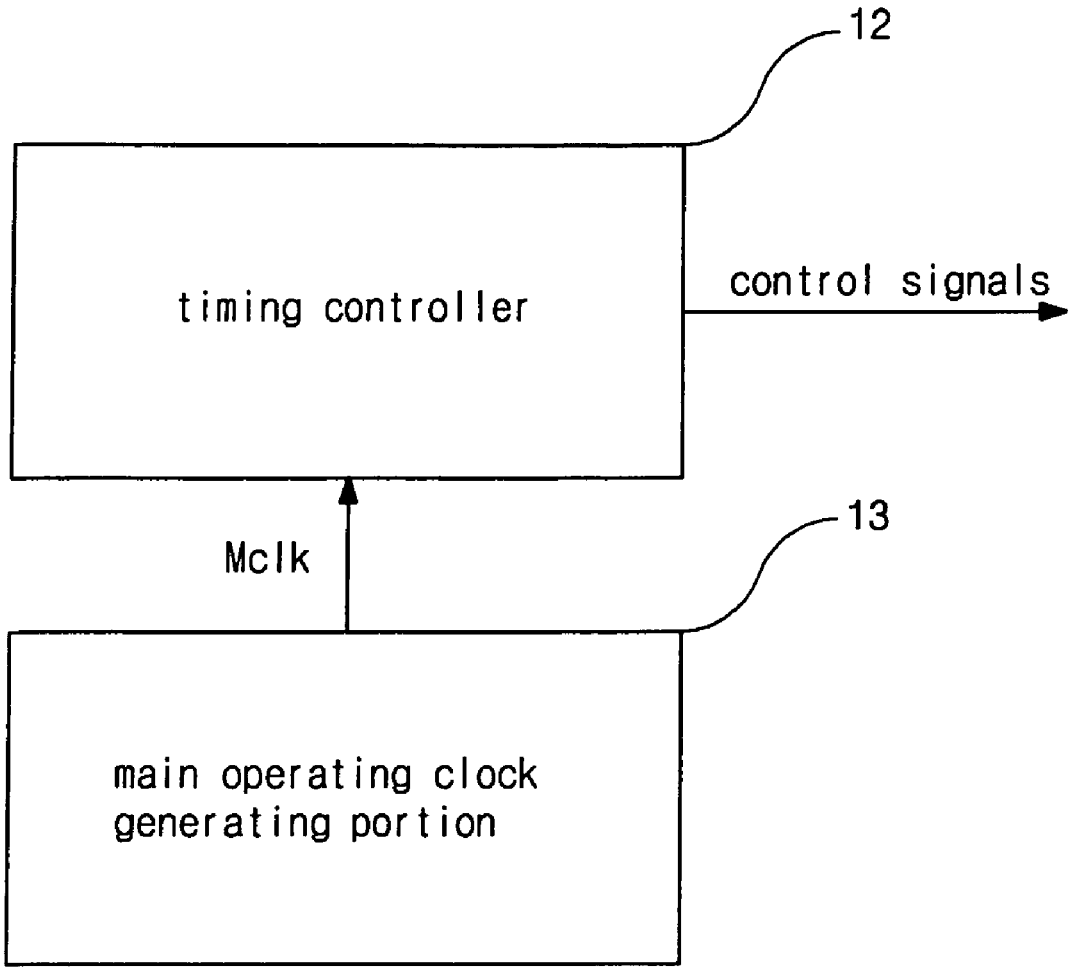
FIG. 3 RELATED ART
FIG. 3 is a block diagram of the related art [PLL] master clock generating portion interfacing the timing controller circuit shown in FIG. 1.

Reference will now be made in detail to exemplary embodiments of the present invention, which are illustrated in the accompanying drawings. Wherever possible, the same reference numbers will be used throughout the drawings to refer to the same or like parts. The LCD device of exemplary embodiments of the present invention has a structure similar to that of the LCD device of FIGS. 1 to 3. Accordingly, detail explanations of parts similar to parts of the LCD device of FIGS. 1-3 will be omitted.

Figure 4:
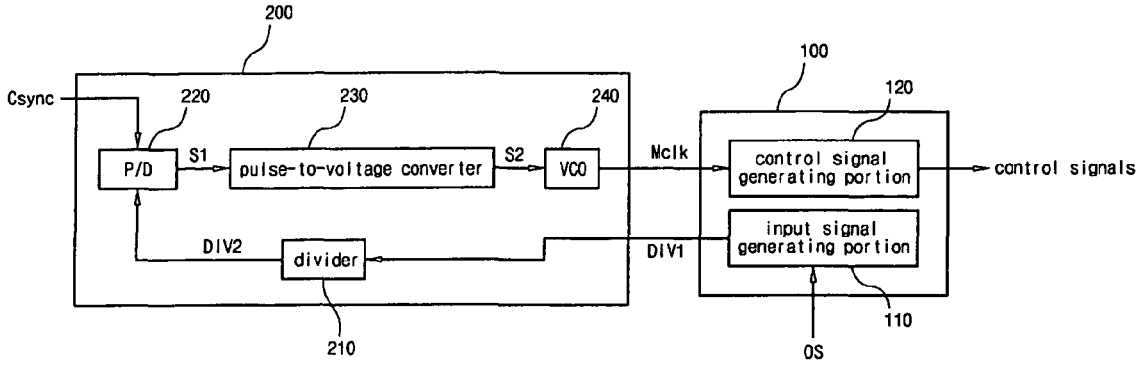
FIG. 4 is a block diagram of an exemplary driving circuit of an analog type display device of an embodiment of the present invention.

FIG. 4 is a block diagram of an exemplary driving circuit of an analog type display device of an embodiment of the present invention. Referring to FIG. 4, a driving circuit includes a timing control portion 100 and a main operating clock generating portion 200. The timing control portion 100 includes an input signal generating portion 110 and a control signal generating portion 120.

The control signal generating portion 120 is supplied with a main operating clock Mclk from the PLL circuit portion 200 and outputs control signals including a source sampling clock (SSC), a gate shift clock (GSC), a source start pulse (SSP), a source output enable (SOE), a gate start pulse (GSP) and a gate output enable (GOE). The source sampling clock (SSC), the source start pulse (SSP), the source output enable (SOE) are sent to a data driver (18 of FIG. 1), and the gate shift clock (GSC), the gate start pulse (GSP) and the gate output enable (GOE) are sent to a gate driver (20 of FIG. 1). Additional signals, such as a Horizontal Synchronization signal (Hsync), a Vertical Synchronization signal (Vsync) and a Frame Rate Pulse (FRP) are sent to the decoder 16 (shown in FIG. 1).

The control signals can be varied, for example, in their frequency and/or in their number, to enable compatibility with different modes of the display device. In an embodiment, a frequency of a main operating clock Mclk can be changed. The frequency of the main operating clock Mclk can be changed by the input signal generating portion 110 and the main operating clock generating portion 200.

The input signal generating portion 110 supplies an input signal DIV1 to the main operating clock generating portion 200 in accordance with an operating mode signal OS externally supplied to the input signal generating portion 110. For example, the input signal generating portion 110 outputs the input signal DIV1 corresponding to the operating mode signal OS. Thus, when an operating mode of the display device is changed, the operating mode signal OS is also changed and inputted to the input signal generating portion 110. Thus, the input signal generating portion 110 outputs the input signal DIV1 having an input frequency corresponding to the changed operating mode signal OS.

For example, a first operating mode signal OS is generated when the display device is driven with a first operating mode, such as a zoom-in mode, and a second operating mode signal OS is generated when the display device is driven with the second operating mode, such as a full screen mode. Accordingly, the input signal DIV1 has a first input frequency corresponding to the first operating mode signal and has a second input frequency corresponding to the second operating mode. Accordingly, the input signal generating portion 110 outputs an input signal DIV1 having different input frequencies depending on the operating modes.

The main operating clock generating portion 200 may use a PLL (phase locked loop) circuit. The main operating clock generating portion 200 includes a divider 210, a P/D (phase detector) 220, a pulse-to-voltage converter 230 and a VCO (voltage controlled oscillator) 240. The divider 210 is supplied with the input signal DIV1 from the input signal generating portion 110. The divider 210 divides the input frequency of the input signal DIV1 by a division ratio, for example, a natural number. The division ratio may be constant for the different operating modes. When the division ratio is constant, the divider 210 outputs a divided signal DIV2 having different divided frequencies depending on the operating modes.

The P/D 220 is supplied with the divided signal DIV2 and a synchronization (reference) signal Csync having a reference frequency. The P/D 220 compares a phase (i.e. frequency) of the divided signal DIV2 with a phase (i.e. frequency) of the synchronization signal Csync and outputs a compared signal S1. The compared signal S1 is a pulse that depends on a difference between the phases of the divided signal DIV2 and the synchronization signal Csync. The reference frequency may be constant for the different operating modes. When the display device is driven with the different modes, because the divided signal DIV2 has the different frequencies, the compared signal S1 also has different waveforms.

A pulse-to-voltage converter 230 converts the compared signal S1 into a control voltage S2. Although not shown in the drawings, the pulse-to-voltage converter 230 includes a C/P (charge pump) and a loop filter. The C/P pumps charges according to a polarity of the compared signal S1. For example, the C/P pushes positive charges to the loop filter when the compared signal S1 is positive and pulls positive charges from the loop filter when the compared signal S1 is negative. The loop filter has a capacitor to store the charges pumped by the C/P. The loop filter filters undesirable frequency parts of the compared signal S1 using a LPF (low pass filter). Accordingly, the pulse-to-voltage converter 230 converts the compared signal S1 into the control voltage S2. When the LCD device is driven with the different modes, because the compared signal S1 has the different waveforms, the control voltage S2 also has different levels.

The VCO 240 is supplied with the control voltage S2 and outputs the main operating clock Mclk having a main frequency according to the control voltage S2. In other words, the main frequency of the main operating clock Mclk corresponds to a level of the control voltage S2. Accordingly, when the display device is driven with the different modes, because the control voltage S2 has the different levels, the main operating clock Mclk also has different main frequencies.

Figure 5:
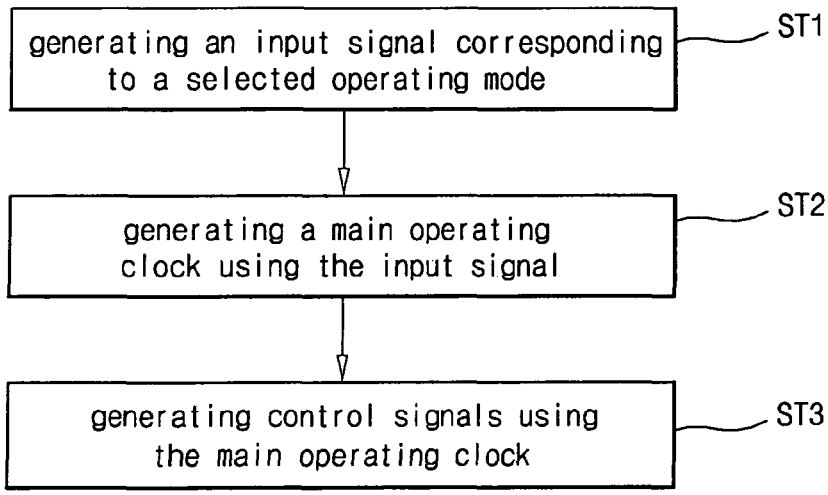
FIG. 5 is a flow chart illustrating an exemplary method of driving a display device of an embodiment of the present invention.

As explained above, as the operating mode of the display device is changed, the input frequency of the input signal is changed, and then the input signal is processed by the main operating clock generating portion. Accordingly, the main operating clock having the main frequency appropriate for driving the display device with the changed mode is also generated FIG. 5 is a flow chart illustrating an exemplary method of driving a display device of an embodiment of the present invention. Referring to FIGS. 4 and 5, during a first step ST1, the operating mode of the LCD device is selected, and the corresponding operating mode signal OS is supplied to the input signal generating portion 110. Then, the input signal generating portion 110 outputs the input signal DIV1 having the input frequency corresponding to the operating mode signal OS.

During a second step ST2, the main operating clock generating portion 200 outputs the main operating clock Mclk using the input signal DIV1 and the externally provided synchronization signal Csync. The divider 210 divides the input frequency by the division ratio to output the divided signal DIV2. Then, the P/D 220 compares the phase of the divided signal DIV2 with the phase of the synchronization signal Csync to output the compared signal S1. Then, the pulse-to-voltage converter 230 converts the compared signal S1 into the control voltage S2. Then, the VCO 240 outputs the main operating clock Mclk corresponding to the control voltage S2.

Although the operating mode can change, the input-to-output conversion attribute of each component of the main operating clock generating portion 200 does not change, and the reference frequency of the PLL does not change. Accordingly, the main frequency of the main operating clock Mclk depends on the input frequency of the input signal DIV1. Therefore, the appropriate main frequency for the selected operating mode is obtained by adjusting the input frequency.

During a third step ST3, the control signal generating portion 120 outputs the control signals corresponding to the main operating clock Mclk. Because the main operating clock Mclk has the main frequency suitable for driving the display device with the selected operating mode, the outputted control signals controls the decoder and the data and gate drivers to display images normally in the selected operating mode.

As described above, by only adjusting the input frequency of the input signal inputted to the main operating clock generating portion, the main frequency of the main operating clock is also adjusted. Accordingly, the main frequency required for the selected operating mode can be obtained without complicated signal processing. Therefore, the display device can be stably driven with various operating modes. In addition, the above-described exemplary embodiments are applicable to other analog type display devices, such as an OLED and a PDP.

It will be apparent to those skilled in the art that various modifications and variations can be made in the display device and the method of driving the display device of the present invention without departing from the spirit or scope of the invention. Thus, it is intended that the present invention cover the modifications and variations of this invention provided they come within the scope of the appended claims and their equivalents.

What is claimed is:

1. A display device, comprising:

an input signal generator generating an input signal comprising one of a plurality of input frequencies corresponding to a respective one of a plurality of operating modes of the display device;

a main operating clock generator generating a main operating clock using the input signal and a reference signal, a main frequency of the main operating clock varying in accordance with the input frequency, and a reference frequency of the reference signal being constant irrespective of the operating modes; and a control signal generator generating a control signal using the main operating clock, the control signal changing in accordance with the main frequency and including a source sampling clock (SSC), a gate shift clock (GSC), a source start pulse (SSP), a source output enable (SOE), a gate start pulse (GSP), and a gate output enable (GOE), the source sampling clock, the source start pulse, and the source output enable being transmitted to a data driver, and the gate shift clock, the gate start pulse and the gate output enable being transmitted to a gate driver, wherein the main operating clock generator includes:

a divider receiving the input signal directly from the input signal generator and dividing the input frequency of the input signal by a division ratio to generate a divided signal, a phase detector comparing a frequency of the divided signal with the reference frequency of the reference signal to generate a compared signal, a pulse-to-voltage converter converting the compared signal into a control voltage, and a voltage controlled oscillator generating the main operating clock comprising the main frequency corresponding to a level of the control voltage, and wherein the control signal generator and the input signal generator forms form a timing controller.

2. The device of claim 1, wherein the division ratio of the divider is constant regardless of the operating modes.

3. The device of claim 1, further comprising a decoder decoding a data signal inputted thereto in accordance with the control signal.

4. A method of driving a display device, the method comprising:

generating an input signal comprising one of a plurality of input frequencies corresponding to a respective one of a plurality of operating modes of a display device;

generating a main operating clock using the input signal and a reference signal through a main operating clock generator, including varying a main frequency of the main operating clock in accordance with the input frequency while keeping constant a reference frequency of the reference signal irrespective of the operating modes; and generating a control signal using the main operating clock, including changing the control signal in accordance with the main frequency, the control signal including a source sampling clock (SSC), a gate shift clock (GSC), a source start pulse (SSP), a source output enable (SOE), a gate start pulse (GSP), and a gate output enable (GOE), the source sampling clock, the source start pulse, and the source output enable is transmitted to a data driver, and the gate shift clock, the gate start pulse and the gate output enable being transmitted to a gate driver, wherein generating the main operating clock through the main operating clock generator includes:

receiving the input signal directly from an input signal generator and dividing the input frequency of the input signal by a division ratio to generate a divided signal through a divider, comparing a frequency of the divided signal with the reference frequency of the reference signal to generate a compared signal through a phase detector, converting the compared signal into a control voltage through a pulse-to-voltage converter, and generating the main operating clock comprising the main frequency corresponding to a level of the control voltage through a voltage controlled oscillator, and wherein a control signal generator generating the control signal and the input signal generator generating the input signal form a timing controller.

5. The method of claim 4, further comprising keeping the division ratio constant regardless of the selected operating mode.

6. A driving circuit for a display device, comprising:

an input signal generator generating an input signal comprising one of a plurality of input frequencies corresponding to a respective one of a plurality of operating modes of the display device;

a main operating clock generator responsive to the one of the plurality of input frequencies to generate a main operating clock, a main frequency of the main operating clock varying in accordance with the one of the plurality of frequencies; and a control signal generator generating a control signal using the main operating clock, the control signal changing in accordance with the main frequency, the control signal including a source sampling clock (SSC), a gate shift clock (GSC), a source start pulse (SSP), a source output enable (SOE), a gate start pulse (GSP), and a gate output enable (GOE), the source sampling clock, the source start pulse, and the source output enable being transmitted to a data driver, and the gate shift clock, the gate start pulse and the gate output enable being transmitted to a gate driver, wherein the main operating clock generator is responsive to a reference signal comprising a constant reference frequency irrespective of the operating modes, wherein the main operating clock generator includes:

a divider receiving the input signal directly from the input signal generator and dividing the input frequency of the input signal by a division ratio to generate a divided signal, a phase detector comparing a frequency of the divided signal with the reference frequency of the reference signal to generate a compared signal, a pulse-to-voltage converter converting the compared signal into a control voltage, and a voltage controlled oscillator generating the main operating clock comprising the main frequency corresponding to a level of the control voltage, and wherein the control signal generator and the input signal generator form a timing controller.

7. The driving circuit of claim 6, wherein an input-to-output conversion attribute of the main operating clock generator is constant regardless of the operating modes.

* * * * *